US006322180B1

(12) United States Patent
Hall et al.

(10) Patent No.: US 6,322,180 B1
(45) **Date of Patent: *Nov. 27, 2001**

(54) VIBRATION RESISTANT SLIDABLE SHELF

(76) Inventors: Donald M. Hall; Ross M. Hall; Morison Ryan Hall, all of P.O. Box 1548, Kingston, NY (US) 12401

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/937,789

(22) Filed: Sep. 24, 1997

Related U.S. Application Data

(60) Provisional application No. 60/035,859, filed on Jan. 21, 1997.

(51) Int. Cl.[7] ..... A47F 3/06

(52) U.S. Cl. ..... 317/128; 108/143; 211/162; 248/657; 248/298.1; 312/114; 312/122

(58) Field of Search ..... 312/132, 116, 312/128, 334.27, 201, 270.3, 273, 330.1, 349, 196, 280, 122; 211/162; 248/298.1, 657; 16/93 R; 108/143

(56) References Cited

U.S. PATENT DOCUMENTS

| | | | | |
|---|---|---|---|---|
| 370,109 | * | 9/1887 | Waldorf | 248/298.1 X |
| 768,041 | * | 8/1904 | George | 248/657 X |
| 1,178,555 | * | 4/1916 | Thomson | 16/93 R X |
| 1,208,979 | | 12/1916 | Kahre . | |
| 1,572,456 | * | 2/1926 | Wicke | 312/116 |
| 1,701,039 | | 2/1929 | Hem . | |
| 1,868,304 | * | 7/1932 | Cargill | 248/298.1 X |
| 1,873,852 | | 8/1932 | Rorrer et al. . | |
| 1,987,796 | | 1/1935 | Rorrer et al. . | |
| 2,774,182 | * | 12/1956 | Beder | 248/298.1 X |
| 2,803,986 | * | 8/1957 | Choiniere et al. | 248/298.1 X |
| 3,279,548 | | 10/1966 | Boukair . | |
| 3,757,967 | * | 9/1973 | Colbridge | 211/162 X |
| 3,934,829 | * | 1/1976 | Coucher | 248/657 X |
| 3,938,602 | | 2/1976 | Sly et al. . | |
| 4,628,756 | * | 12/1986 | Kimura et al. | 248/657 X |
| 4,763,738 | | 8/1988 | Kuchler . | |
| 5,072,838 | * | 12/1991 | Price, Jr. et al. | 211/162 |
| 5,232,061 | | 8/1993 | Neeleman . | |
| 5,386,787 | | 2/1995 | Hall . | |
| 5,471,922 | | 12/1995 | Hall . | |

FOREIGN PATENT DOCUMENTS

| | | | | |
|---|---|---|---|---|
| 429659 | * | 7/1967 | (CH) | 211/162 |
| 3337467 | * | 4/1985 | (DE) | 312/116 |
| 0279963 | * | 8/1988 | (EP) | 312/116 |
| 609578 | * | 10/1948 | (GB) | 16/93 R |
| 1217084 | * | 2/1967 | (GB) | 312/132 |
| 404325117 | * | 11/1992 | (JP) | 312/128 |
| 6508781 | * | 1/1966 | (NL) | 211/162 |

* cited by examiner

*Primary Examiner*—Peter M. Cuomo
*Assistant Examiner*—Michael J. Fisher
(74) *Attorney, Agent, or Firm*—Shlesinger, Arkwright & Garvey LLP

(57) ABSTRACT

A first device for use in conjunction with display cases include a frame, a support member slidably disposed on the frame, an arm disposed on the support member for slidable movement therewith, a first work surface disposed on the support member, and a dampening member disposed between the second work surface and the support member for reducing vibration transfer to the first surface. A second device comprises a rail, a support member slidably disposed on the rail, and a dampening member disposed between the rail and the support member. A third device includes a window frame slidably engaged with a display case, a window supported by the frame member, and a work surface disposed on the frame member.

19 Claims, 10 Drawing Sheets

FIG. 12
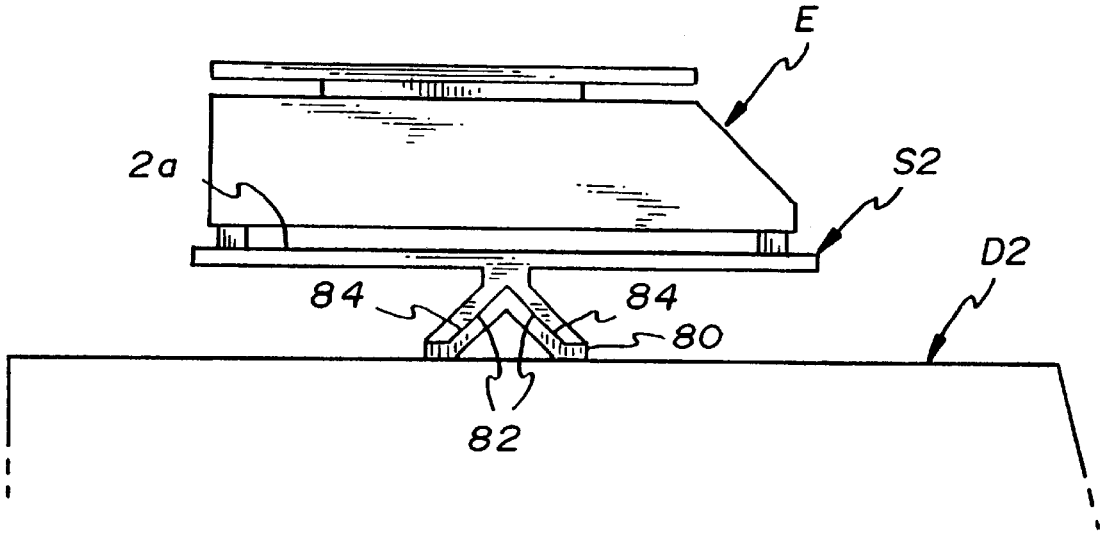
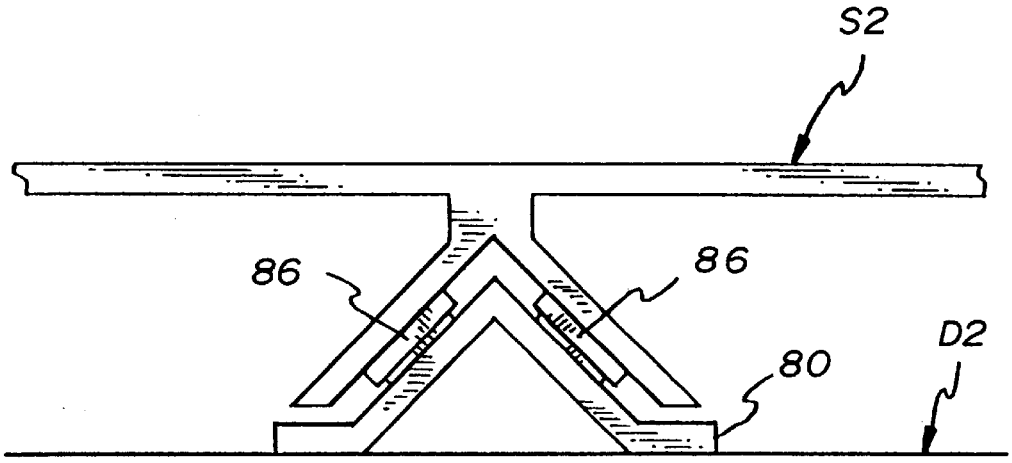
FIG. 13

VIBRATION RESISTANT SLIDABLE SHELF

CROSS REFERENCE TO RELATED APPLICATIONS

This application claims the priority of Provisional Application No. 60/035,859, filed Jan. 21, 1997, which is incorporated herein by reference.

FIELD OF THE INVENTION

This invention relates generally to devices for enhancing the movement of objects relative to other objects. In particular, this invention relates to moving devices relative to delicatessen counters. Still more particular, this invention relates to reducing vibration between different components of existing delicatessen equipment, as well as reducing vibration between the inventive components and existing delicatessen equipment.

BACKGROUND

Often, industrial and service areas employ sensitive measuring devices that need to be moved around a work station or area. Generally, these measuring devices are extremely sensitive to vibrations and movement.

For example, delicatessens commonly employ accurate but sensitive electronic weighing devices. Various devices for supporting equipment for working on work pieces and for providing some vibration resistance thereof are known in the art. Examples of various conventional devices are shown in U.S. Pat. Nos. 5,232,061; 1,701,039; 3,279,548; 3,938,602; 4,763,738; 1,987,796; 1,873,852; and, 1,208,979.

An earlier slidable work surface system that works well is disclosed in U.S. Pat. No. 5,386,787 to Hall, reducing vibration is discussed generally in columns 7 and 8 thereof. The present system further improves upon the '787 patent.

Another system for supporting slicers and the like is shown in U.S. Pat. No. 5,471,922 to Hall. Hall '922 likewise works well for its intended purposes, and the instant invention is even better suited for supporting sensitive equipment.

Accordingly, there is a need for a support frame for equipment, which is easy to operate, easy to construct, versatile for accommodating different size equipment, and which allows for the equipment to be moveable or slidable about the work station or area.

Machines and devices other than the sensitive equipment are often operating near or around the sensitive equipment. In order for the relatively sensitive equipment to operate accurately, it is imperative that vibrations from the other machines be eliminated or at least reduced.

OBJECTS AND SUMMARY OF THE INVENTION

It is an object of the present invention to provide a slidable scale shelf, which overcomes the drawbacks of prior art devices.

Another object of the present invention is to provide a slidable scale shelf, which is vibration resistant.

Another object of the present invention is to provide a vibration resistant slidable scale shelf that travels along a rail with at least one other shelf linked to the scale shelf for movement therewith.

Yet another object of this invention is to provide a vibration resistant slidable scale shelf, which includes a vibration resisting frame support for movement thereon.

Still a further object of this invention is to provide a vibration resistant, slidable scale shelf for use in the retail trade, such as in grocery stores, delicatessens, bakeries, etc.

Yet another object of this invention is to provide a vibration resistant device that will allow a sensitive weighing scale to move parallel to a refrigerated, or similar, case so that a worker can readily access the scale from a number of different positions from the back of the case.

A further object of this invention is to provide a slidable, vibration resistant scale shelf, which is slidably mounted to a frame that is directly attached to a display case.

Yet another object of the present invention is to provide a slidable, vibration resistant scale shelf, which is adapted to slide relative to and/or replace a pre-existing sliding glass window of a display case.

A further object of this invention is to provide a slidable scale shelf that extends above the display case for easy view thereof by the customer and the worker and which slides in conjunction with another shelf.

Still a further object of this invention is to provide a slidable, vibration resistant scale shelf, which is inexpensive to manufacture and maintain.

In summary, the invention provides for a vibration resistant, slidable work surface, which overcomes the drawbacks associated with conventional devices, is easy to use, versatile, and helps improve accurate readings for sensitive measuring equipment in and around a work station.

DESCRIPTION OF THE DRAWINGS

The above and other objects and advantages and novel features of the present invention will become apparent from the, following detailed description of the preferred embodiment of the invention illustrated in the accompanying drawings, wherein:

FIG. 12 is a side elevational view of the assembly and frame of FIG. 11.

FIG. 13 is an alternative embodiment of the slidable work member frame of FIG. 12.

DETAILED DESCRIPTION OF THE INVENTION

FIGS. 1–5

Figure 1:
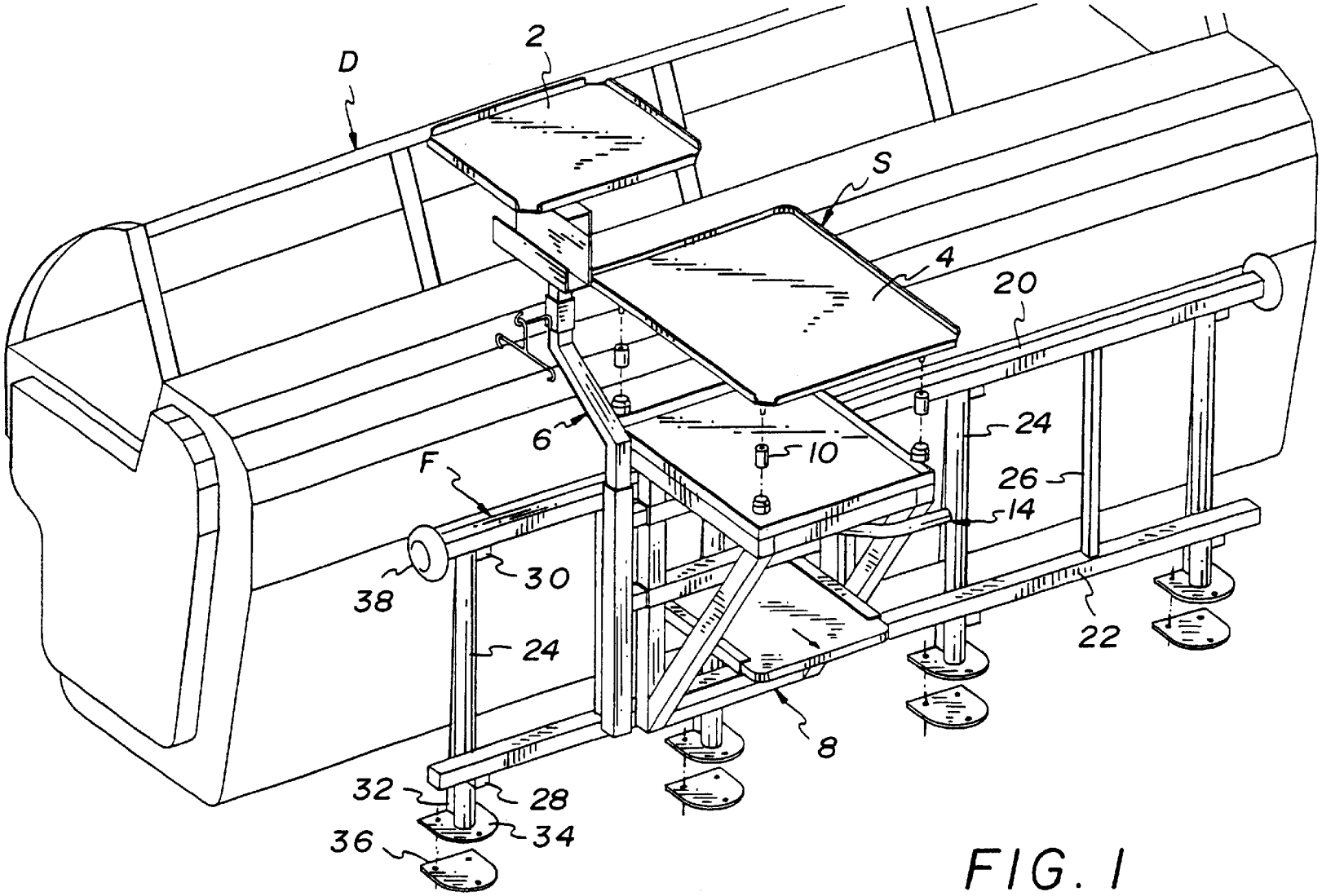
FIG. 1 is a partially exploded, perspective view of a slidable work assembly and a frame made in accordance with the present invention.

Referring to FIG. 1, the preferred embodiment of the invention includes generally, a slidable work assembly S and a frame assembly F. The slidable work assembly S and the frame assembly F each include vibration dampening characteristics, provided by this invention.

The slidable work assembly S is comprised of a first work surface 2, a second work surface 4, an arm 6, a support member 83, a plurality of compression bushings 10, vibration dampening rollers 12 (shown in FIG. 2), and a brake assembly 14.

It is noted that there may be more than two work surfaces that make up the slidable work assembly S.

The slidable work assembly S is designed to reduce vibration from various equipment located on the assembly S. Namely, equipment such as a meat slicer, or the like, will be placed on the second work surface 4, and a sensitive electronic weighing device, or scale, will be placed on the first work surface 2.

Under normal operating conditions of a conventional system, an unillustrated meat slicer will produce and transmit vibrations into the surface 4 upon which it is resting. These vibrations would transfer through the assembly S to an unillustrated electronic scale on work surface 2. Such vibrations would hinder the accuracy of the sensitive scale. Accordingly, to obviate the transfer of vibration, the present invention employs a plurality of compression bushings or rubber shock mounts 10 between the second work surface 4 and the support member 8.

The arm 6 is connected to the support member 8. The arm 6 extends upwardly from the support member 8 to support the first work surface 2, upon which an electronic scale may be placed. It is desirous for the arm 6 to extend upwardly from the support member 8 above the display case D so that the purchaser or customer, as well as the worker, or operator, can see the reading of the scale. However, it is noted that the arm 6 does not need to extend over the case. Rather the arm 6 needs to be just high enough to be accessible and readily viewable by customers, preferably, and, typically workers. The arm 6 is also extendible or telescopic to allow adjustments of the arms height or length.

Figure 2:
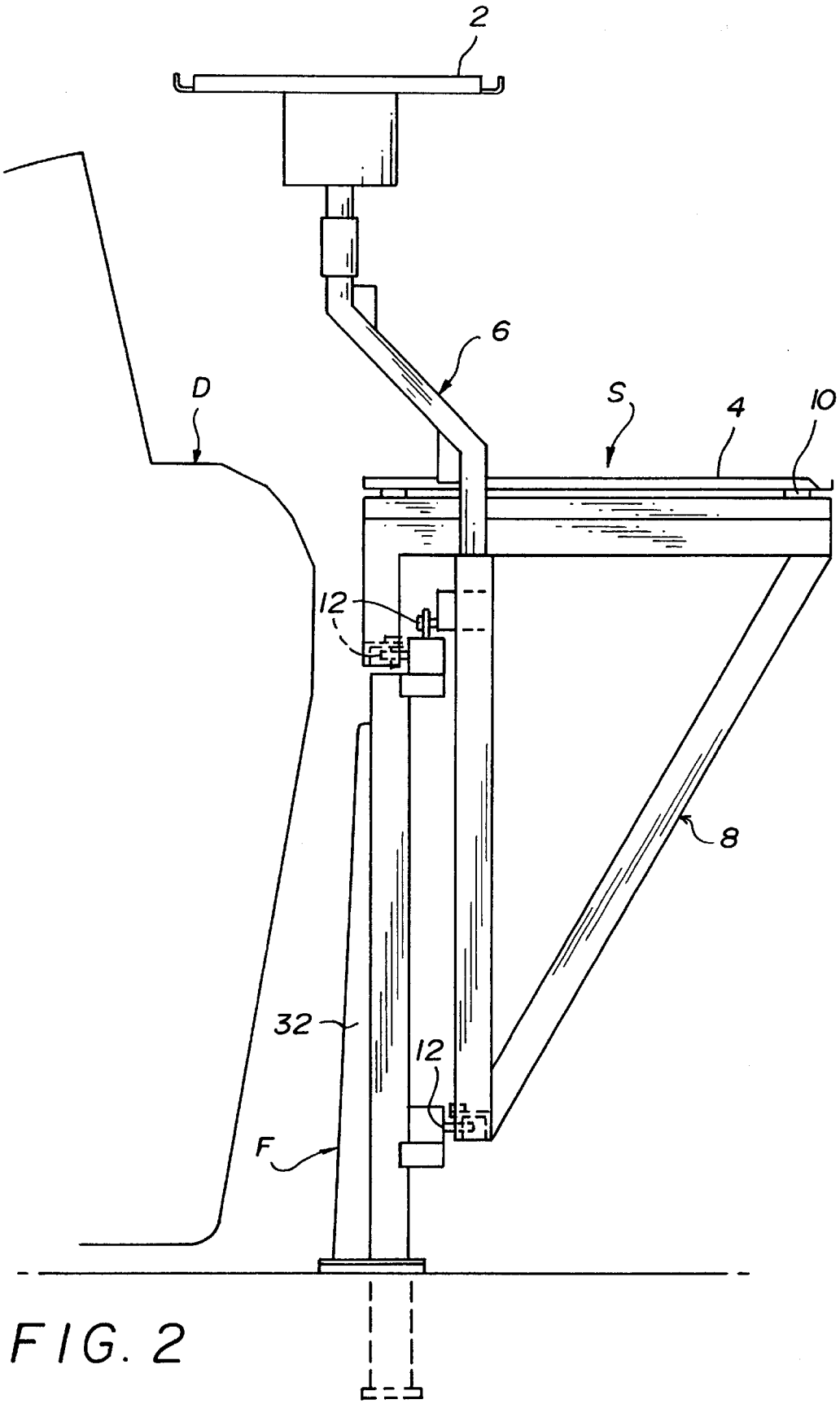
FIG. 2 is a partial side view of the frame and assembly shown in FIG. 1.

Attached to the support member 8, are rollers 12 and brake assembly 14. The rollers 12 are typically made of plastic or some other similar shock absorbing material, so as to decrease the vibration transfer to the electronic scale during movement of the slidable work assembly S. The rollers 12 may also be made of stainless steel. FIG. 2 displays the rollers 12. The brake assembly 14 will allow the slidable work assembly S to be temporarily restrained in a certain location along the frame F and to further reduce the vibration transfer from the slicing machine to the scale by firmly locking the assembly S in one location. Note, for clarity purposes, the stops 38 are not shown in FIG. 2.

The assembly S is designed to allow the conjunctive movement of the two work surfaces 2 and 4. Thus, when a worker slides the assembly S down the frame F to use a meat slicer located on the second work surface 4, the first work surface 2, with the scale thereon, will slide with the second surface 4 and then be readily accessible for the user to place the newly sliced meat, or the like, on the scale.

A sample brake that may be employed can be seen in U.S. Pat. No. 5,386,787 granted to Hall. U.S. Pat. No. 5,386,787 is hereby incorporated by reference with particular attention directed to the brake disclosed therein in FIGS. 2, 3 and 4.

Referring again to FIG. 1, the frame F includes an upper rail or track 20 along with a vertically spaced apart and substantially parallel lower rail or track 22. A plurality of vertical spacers 24 maintain the spacing between upper rail 20 and lower rail 22, as well as serve to strengthen the frame F.

There are also a plurality of vertically extending uprights or main support members 26 which support the frame F and the slidable work assembly S. To support the rails 20 and 22, the uprights 26 have lower ears 28 and upper ears 30. The lower ears 28 correspond or connect with the lower rail or track 22, as the upper ears 20 correspond or connect with the upper rail 20.

As can be seen in FIG. 1, the frame F is placed adjacent to a display case D. This embodiment of the frame F is a stand alone system. In other words, it is not connected to the display case D. Accordingly, to provide further lateral support in substantial vibration resistance, gussets 32 are provided adjacent the uprights 26. Located at the lower ends of the uprights are mounting plates 34. These mounting plates 34 connect the frame F to the floor. The mounting plates 34 can be cemented, glued, bolted, or otherwise connected to the flooring surface of the work area.

To further enhance the vibration resistance of the entire system, dampening pads 36 are placed between the mounting plates 34 and the floor. To attach the frame F to the floor fasteners, such as bolts, are used with rubber or equivalent washers to isolate the fastener from the mounting plates 34.

The slidable work assembly S slides along the tracks 20 and 22. In order to prevent the slidable work assembly S from inadvertently sliding off of the frame F, stops 38 are typically provided.

Figure 3A:
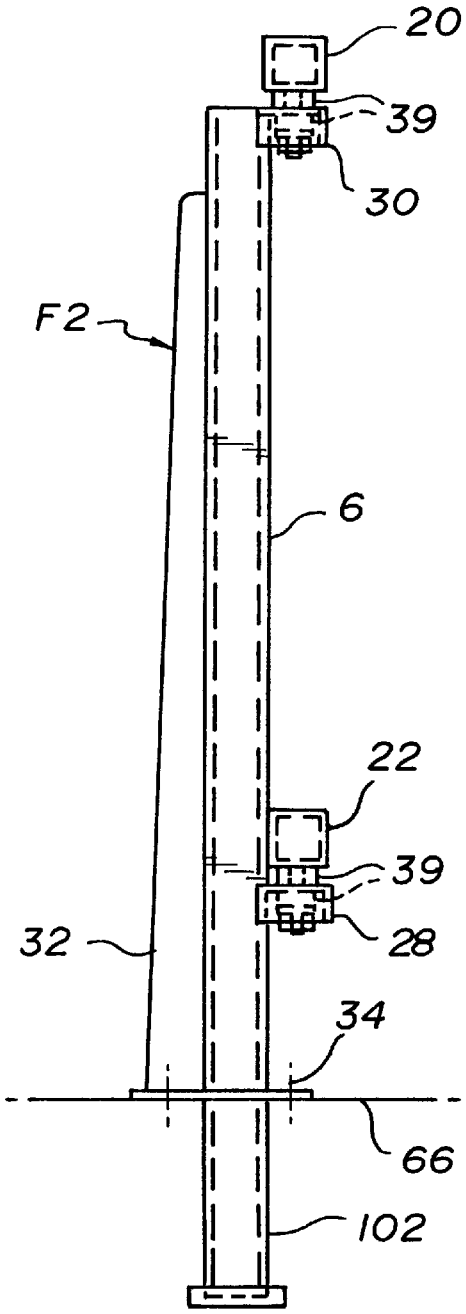
FIG. 3A is a side elevational view of an alternative embodiment of the frame.
Figure 3B:
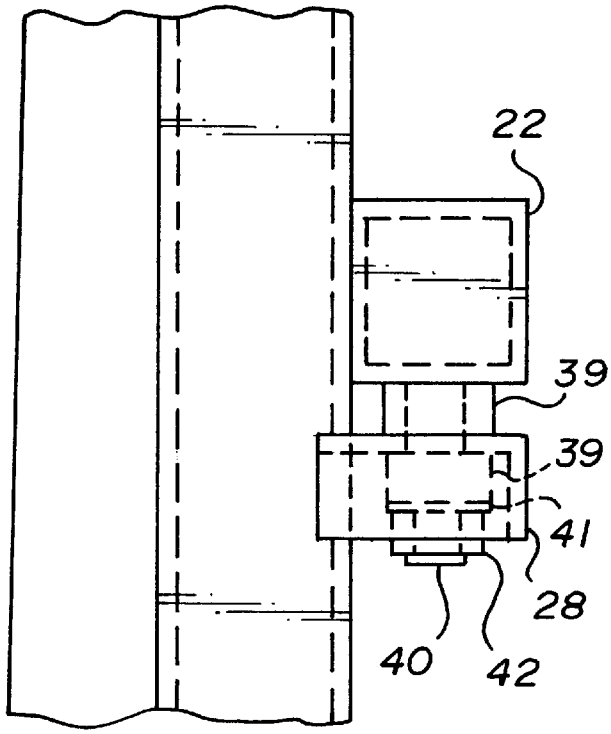
FIG. 3B is a partial side elevational view of the frame of FIG. 3A.

Referring to FIGS. 3A and 3B, where an alternative frame F2 embodiment is illustrated and additional ear shock mounts 39 can be seen. The modifications disclosed here can be adopted to any of the frame embodiments disclosed herein. These ear shock mounts 39 are placed between the ears 28 and 30 and their respective tracks 20 and 22. As can be seen in FIG. 3B, ear shock mounts 39 can be disposed on both sides of the ears 28 and 30. For example, a bolt 40, extends from the rail 22, through a ear shock mount 39, then through the lower ear 28, through another ear shock mount 39, then through a metal washer 41 and secured with a nut 42. This arrangement completely isolates the ears 28 and 30 and thus eliminates vibration transfer from the ears 28 and 30 to the rails 20 and 22.

Frame F2 includes submembers 102, which are an extension of the uprights 6. The submembers 102 are an alternative way of mounting a frame to a floor 66. A hole is drilled into the floor 66 and the submembers 102 are inserted into the hole and then the hole is filled with cement.

The ear shock mounts 39, as well as the dampening pads 36, shown in FIG. 1, provide vibration transfer resistance from any vibration conducted through the flooring of the work area. Refrigerator devices or other machines located in the surrounding area could generate vibration. Such vibration might transfer through the flooring of the area and as well as through the frame F. To prevent such transfer, the dampening pads 36 and the ear shock mounts 40 are employed; other features preventing vibration transfer will be disclosed below.

Figure 4:
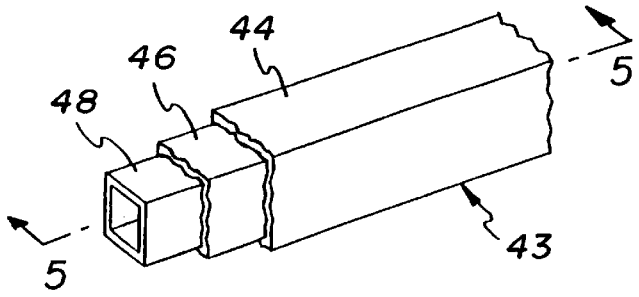
FIG. 4 is a partial perspective of sample tubing.
Figure 5:
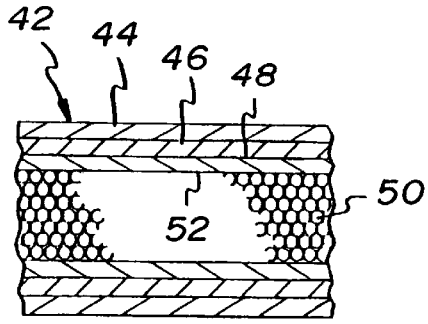
FIG. 5 is a cross sectional view of the sample tubing of FIG. 4.

Referring to FIGS. 4 and 5, a tubing 43 is illustrated. This tubing 42 is used for the construction of the frame F and can be used for the construction of the various parts of the slidable work assembly S, namely, the arm 6 and the support member 8.

The tubing 43 is preferably hollow, or a conduit. Additionally, to enhance vibration resistance or to deter or hinder vibration transfer, it is preferred for the tubing 43 to be made of three walls, namely, a first wall 44, a second wall 46 and a third wall 48. Having three walls 44, 46 and 48 will reduce the vibration transfer, as opposed to having 1 solid wall. Further, it is preferred that the three walls 44, 46 and 48 be of dissimilar materials, which will aid in reducing the transfer of vibration from one wall to the next. The cross sectional shape of the tubing 43 is shown as rectangular but it is understood that many other shapes may be employed.

Referring to FIG. 5, a partial cross section of a sample tube 43 is illustrated. To further enhance the vibration resistant characteristics of the tubing 43, the use of some material 50 may be employed within the interior conduit space 52 of the tubing 43 to absorb vibration. An example of such material 50 is lead shot. However, the material 50 can also be foam or any vibration absorbing material. This vibration absorbing material 50 may be used to fill only portions of the tubing 42 or all of the conduit space 52 of the tubing 42.

FIGS. 6–9

FIGS. 6, 7, 8 and 9 illustrate other possible embodiments of the frame F. It is noted, the embodiments illustrated herein do not comprise all the possible embodiments of the frame F. This invention incorporates all frames F that perform substantially the same functions, as the embodiments disclosed, in substantially the same way, and which lead to the same result of providing dampening resistance and support as disclosed herein.

Figure 6:
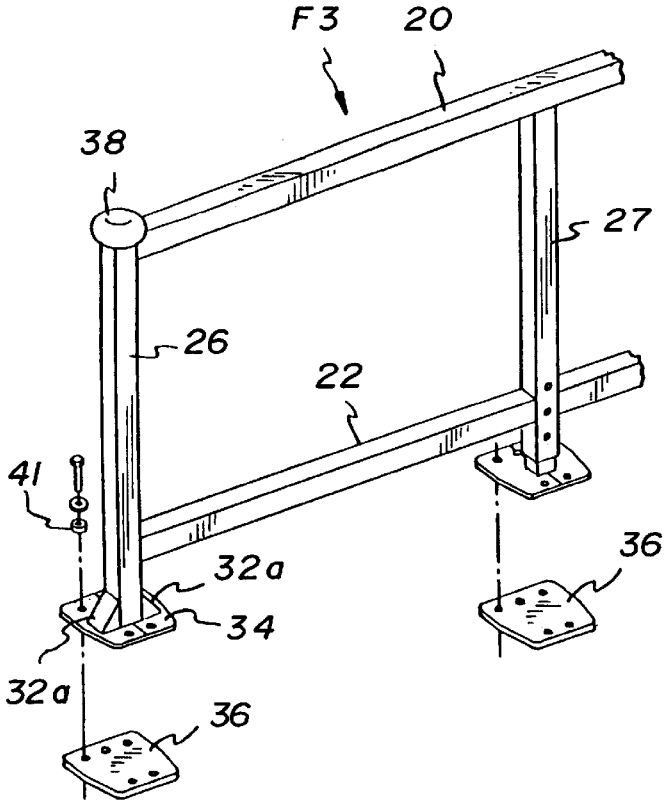
FIG. 6 is a partially exploded, perspective view of an alternative embodiment of the frame.

FIG. 6 displays an alternative frame F3 embodiment of the frame F. The adjustable uprights 27 are height adjustable in this embodiment. With the uprights 27 being height adjustable, it will allow for the frame F3 to be more versatile for work places that may have uneven flooring. Note, the gussets 32*a* are also a different embodiment from the previous gussets 32. It is understood, that various size gussets 32*a* could be employed at various places along the frame F2 to provide further vibration transfer resistance. In this embodiment, vertical spacers 24 are not employed. Additionally, the lower rail 22, in this embodiment, is non-continuous.

Figure 7:
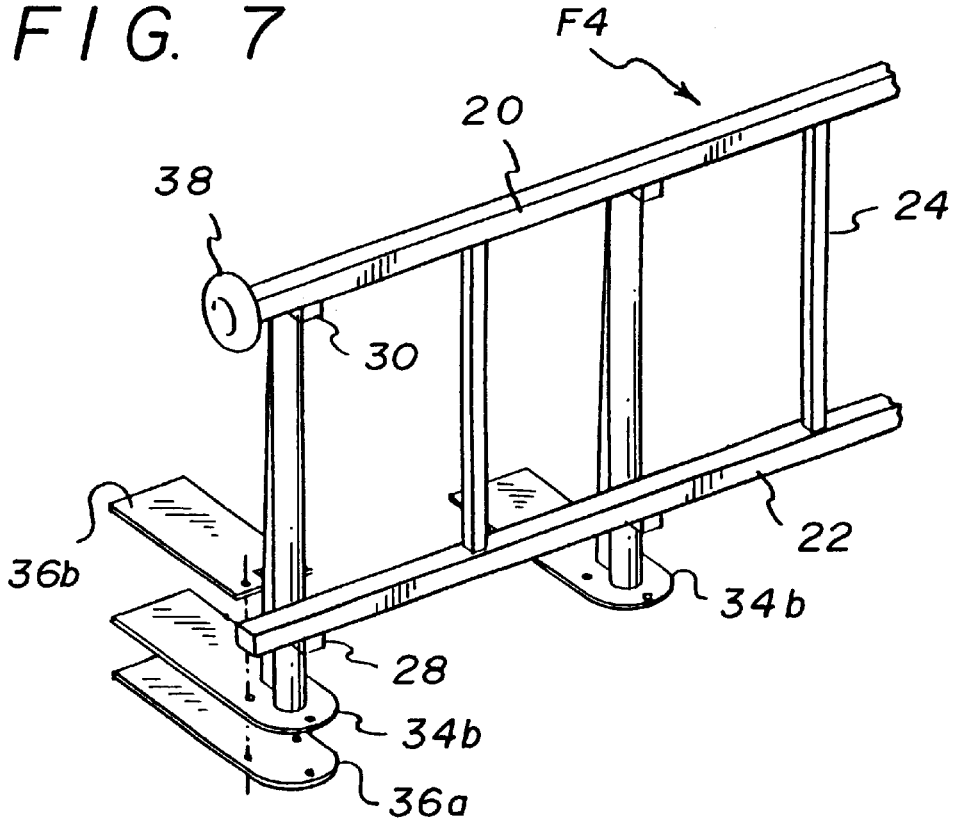
FIG. 7 is a perspective view of an alternative embodiment of the frame.

Referring to FIG. 7, another frame F4 embodiment of the frame F is illustrated. This embodiment is similar to the frame F shown in FIG. 1. Here, the mounting plate 34*b*, termed a duck foot design, is shown in an alternative configuration. The mounting plate 34*b* is adapted to extend under a display case D, not shown. In this arrangement, the weight of the display case D will counter against the moment created by the slidable work assembly S, namely the lateral forces at the height of upper rail 20. Preferably a rubber cushion 36*a* is placed between the duck foot, mounting plate 34 and the case D. Another cushion or pad 366 is disposed between the duck foot and the floor.

Figure 8:
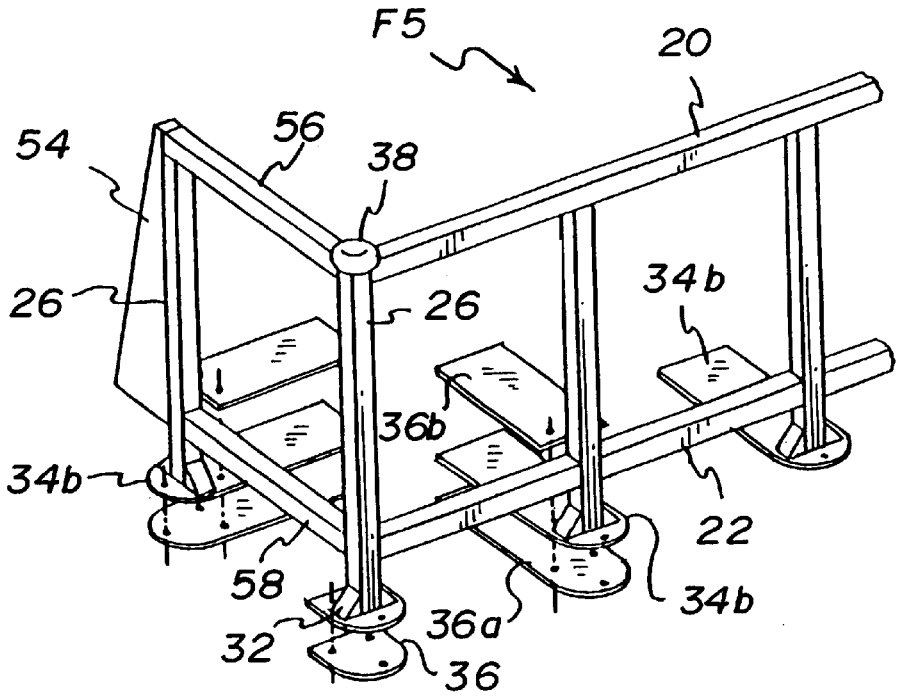
FIG. 8 is a perspective view of an alternative embodiment of the frame.

FIG. 8, illustrates frame F5 yet another embodiment of the frame F. This embodiment includes two frame side members or extensions FS. Each side member FS includes a counterweight 54, a side top rail 56 and a side lower rail 58. Between the two rails 56 and 58 are uprights 26, as described above for the rails 20 and 22. The counterweights 54 are adapted to be either removably mounted or fixed to an end upright 26 of frame side FS. The counterweights 54 are employed to help compensate for the weight of the slidable work assembly S that will be mounted on the frame F5. The counterweights 54 will prevent the frame F5 from tipping. Additionally, the counterweights 54 may also eliminate the need for mounting the frame F5 to the floor.

It is understood that one may still attach any of the frame F embodiments to the floor, by bolting, cementing, etc. In FIG. 8, the mounting plates 34 in the duck foot design are shown. As mentioned above, this design will allow the case D, not shown, to rest on the plates 34 to further assist in preventing the frame FS from tipping and to eliminate the need of having to attach the frame F5 to the floor.

Figure 9:
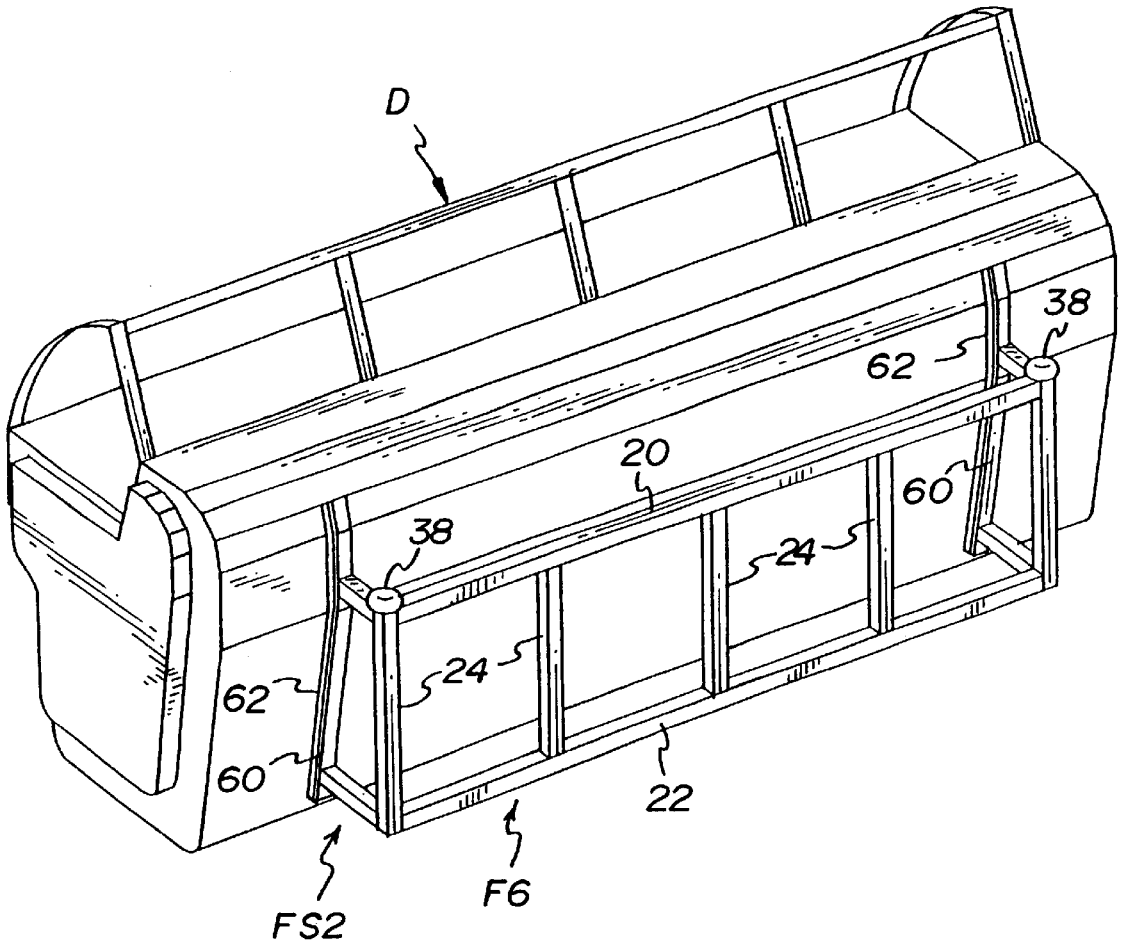
FIG. 9 is a perspective view of an alternative embodiment of the frame.

Referring to FIG. 9, a further frame F6, another alternative embodiment of the frame F, is shown. This embodiment of the frame F includes modified frame sides members FS2. This embodiment is adapted to be attached or removably mounted to the display case D. Thus, no floor mounting hardware is necessary. Furthermore, with the frame F6 off of the floor, cleaning of the floor is made easier as one can sweep or mop under the frame F6 more easily than in the above-described embodiments. To mount the frame F6 to the case D, mounting brackets 60 are used. These mounting brackets 60 are adapted to attach to the side top rails 56 and the side lower rails 58 of the frame side member FS2. To hold the brackets 60 the case D, bolts, screws or the like may be used. The brackets 60 could even be welded to the case D. To reduce or eliminate vibration transfer from the case D to the frame F6 and subsequently to the slidable work assembly S, not shown, mounting pads 62 are disposed between the brackets 60 and the case D. The pads 62 can be of any dampening material such as rubber, foam, or the like.

FIGS. 10A AND 10B

Figure 10A:
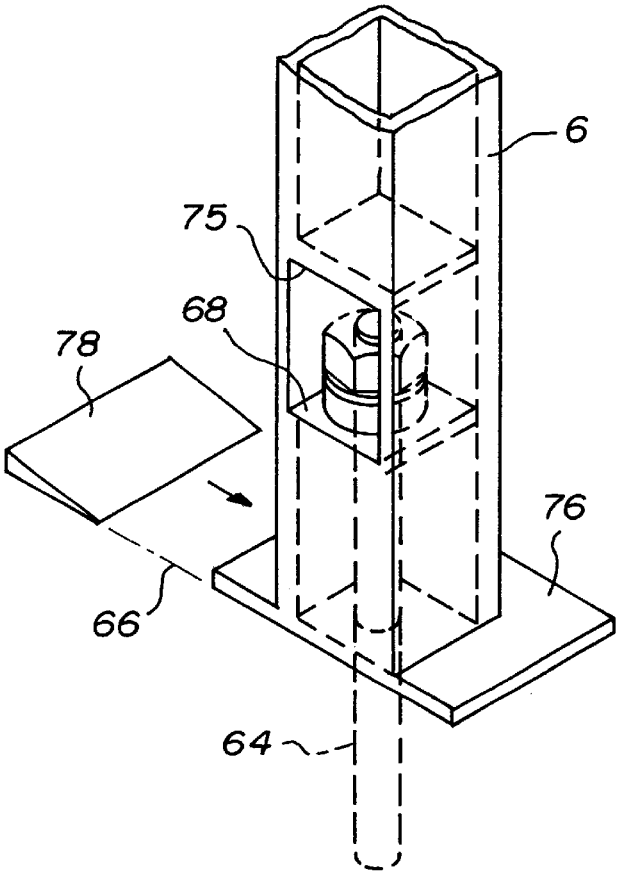
FIG. 10A is a perspective view of an alternative embodiment for the frame mounting.
Figure 10B:
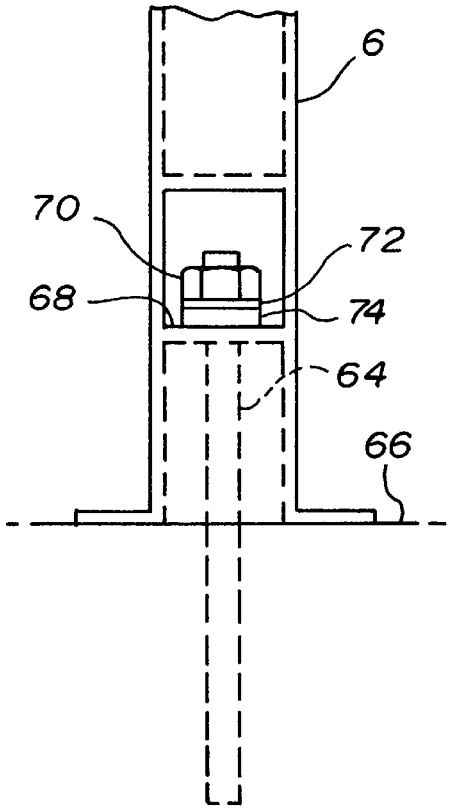
FIG. 10B is a front elevational view of the mounting of FIG. 10A.

FIGS. 10A and 10B illustrate a further way to mount or attach the frame F to the work area floor. A threaded rod 64 is shown extending from the floor line 66 and into the upright 6. To lock or secure the upright 6 to the rod 64, the upright 6 has a substantially horizontal bracket S9 that the rod 64 extending through and then a nut 70, a washer 72 and a rubber dampener 74 are threaded on to the rod 64. The rubber dampener 74 will help eliminate vibration transfer from the floor to the upright G.

To tighten and loosen the nut 70, the upright 6 will have an open face 75. In other words, a portion of the wall of the upright 6 is removed to allow access to the nut 70.

To stabilize the upright 6, it has a flange 76 located at its base for engagement with the floor much like the mounting plates 34 discussed above. Some work area floors are not perfectly level. As such, it is possible that the flange 76 may not completely engage the floor. Thus, shims 78 may be employed, by wedging the shims 78 under the flange 76, to level the upright 6 or compensate for the varying contours of uneven floors.

FIGS. 11–15

Figure 11:
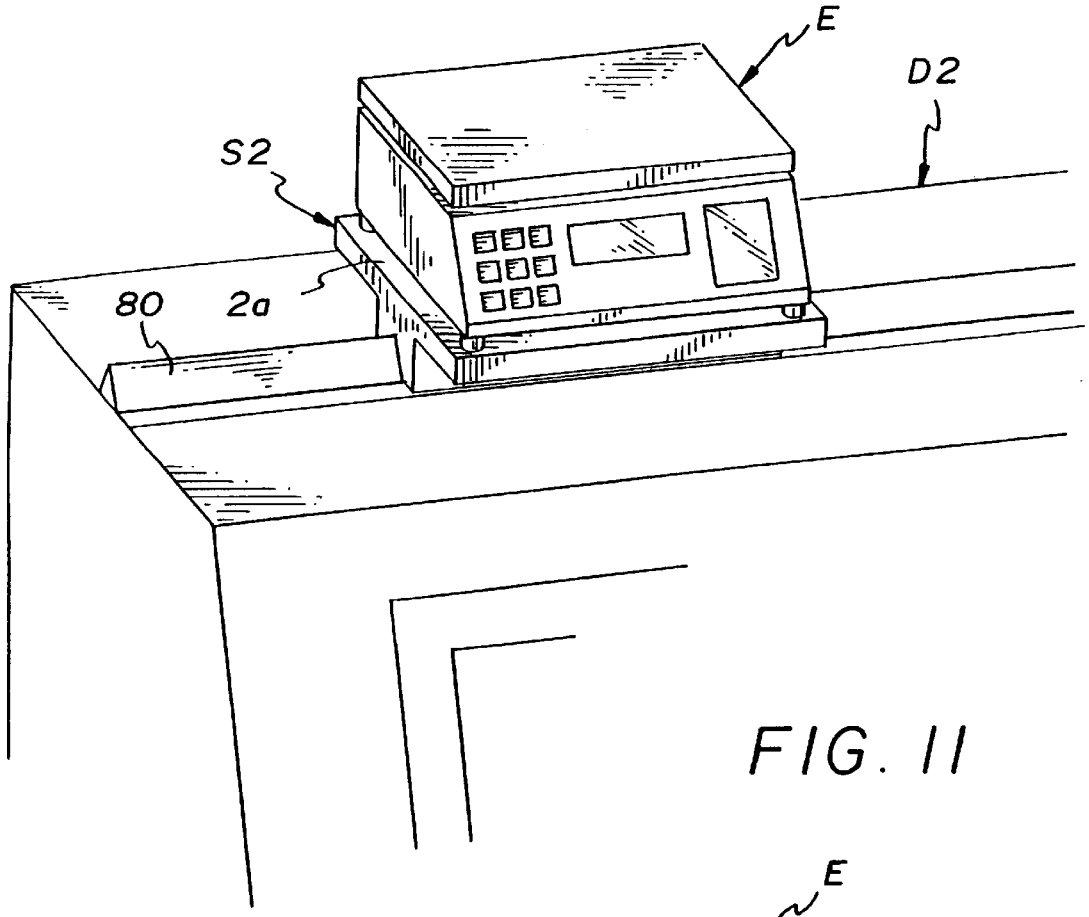
FIG. 11 is a perspective view of an alternative embodiment of the slidable work assembly and the frame.

Illustrated in FIGS. 11–13, is an alternative embodiment of the sliding scale system. This embodiment is also designed to reduce vibration transmitted to the sensitive electronic scale.

Referring to FIG. 11, an American style display case D2 is shown as well as a modified slidable work assembly or member S2 having a first work surface 2*a*, with an electronic scale E placed thereon. The slidable work member S2 slides on a rail or modified frame 80. The rail 80 is mounted directly to the top of the case D2. It is preferred to mount the rail 80 in the location shown, namely the center of the top of the case D2 because at this location there is typically the least amount of vibration transferred from the case D2. Note, this embodiment can be adapted to be employed with numerous types of display cases not just the American style D2.

Referring to FIG. 12, an end view of the embodiment shown in FIG. 11 can be seen. Note how the slidable member S is adapted to mate with the shape of the triangular shaped rail 80. In other words, the engagement surface 82 of the slidable member S engages the engagement surface 84 of the rail 80. With this arrangement, the slidable member S will not wobble or tip while sliding on the rail 80 an a vibration transfer from the rail 80 to the member S will be minimal.

To enhance the sliding of the member S and the vibration resistance, vibration resistant rollers 86 can be employed, as shown in FIG. 13. The rollers 86 may be attached to either engagement surface 82 or 84. FIG. 13, shows the rollers 86 as ball bearings rotatably attached to the surface 82.

The rollers are preferably made of a rubber material to further reduce vibration transfer from the case D to the scale E. The rollers 86 may be anti-vibration ball bearings or low-coefficient of friction sliding blocks.

Figure 14:
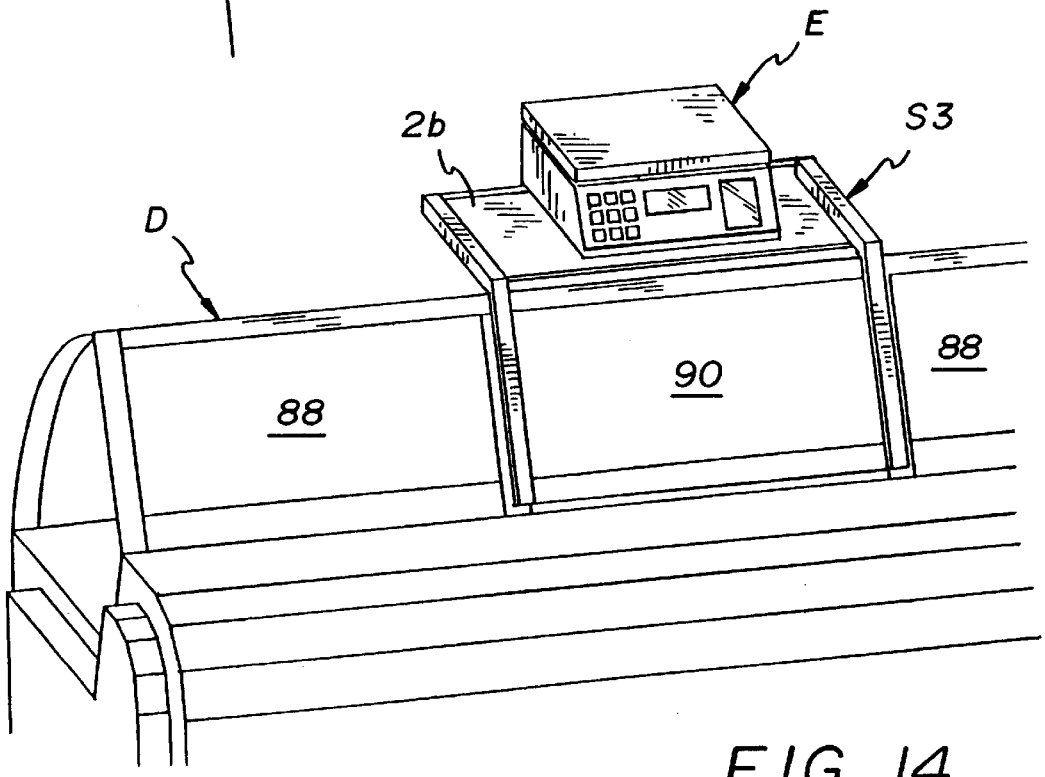
FIG. 14 is a perspective view of an alternative embodiment of the slidable work assembly.
Figure 15:
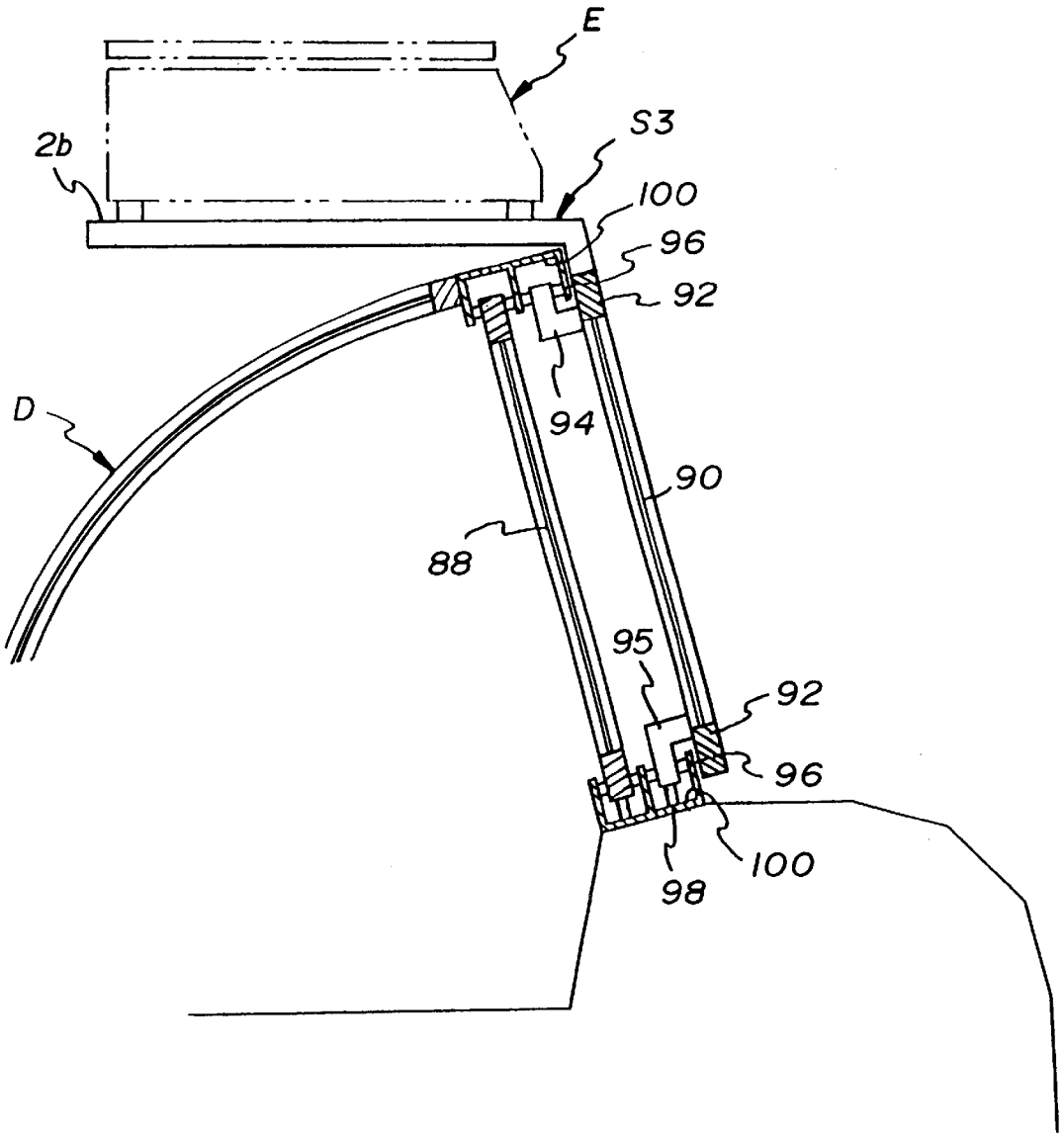
FIG. 15 is a side elevational view of the alternative embodiment of the work assembly of FIG. 14.

Illustrated in FIGS. 14 and 15, is an alternative embodiment of the sliding scale system. This embodiment is also designed to reduce vibration transmitted to a sensitive electronic scale and to efficiently use a minimal amount of space.

FIG. 14 shows a European style display case D with a plurality of sliding windows 88. An electronic scale E is shown resting on the first work surface 2*b* of a modified sliding work assembly S3, which is adapted to replace a preexisting sliding window 88.

FIG. 15 shows the modified sliding work assembly S3 having a first work surface 2*b*, a window 90, a window frame 92, which surrounds or supports the window 90 and to which the surface 2*b* is attached, a plurality of engagement arms 94 and 95 attached to the window frame 92, a plurality of side rollers 96 and a plurality of end rollers 98. The surface 2*b* is designed to extend from the display case D so that the customers and the user can both see the scale E. It is further preferred that the surface 2*b* extend above the case D to facilitate ease of viewing. It is also preferred that the window 90 be clear to enable the user or worker to see through the window 90 and into the case D).

This embodiment, as mentioned above, is designed to replace a preexisting sliding display case window 88. Accordingly, this embodiment is designed to slide along the case D, just as the window 88 that it replaces did. To enable the modified sliding work assembly S3 to slide, the upper engagement arms 94 and the lower engagement arms 95 have a roller attached thereto. The arms are adapted to extend into the window channel 100 of the case D. It is understood that only a minimal number of rollers are needed in various locations on the arms 94 and 95, so long as the modified sliding work assembly S3 will slide in the channels 100.

It is preferred that the rollers 96 and 98 be of a vibration resistant material such as rubber. Additionally, to reduce the weight of the system and to reduce vibration, the window frame 92 may be made of plastic, may have at least three layers of dissimilar materials as its walls and may have vibration absorbing material, such as foam, within its interior chamber, not shown, as discussed above for tubing 43.

If it is desired not to replace an existing sliding window 88, one could simply attach an additional sliding channel, not shown, parallel to the existing channels 100, to provide a channel for the sliding work assembly S3 to engage.

A person of ordinary skill in the art will understand that the present invention will provide vibration resistance for a sliding work surface and allow multiple vibration resistant surfaces to conjunctively move or slide along throughout a work area preventing vibration transfer from one surface to the other and while using space efficiently.

While this invention has been described as having a preferred design, it is understood that it is capable of further modification, uses and/or adaptions following in general the principles of the invention and including such departures from the present disclosure as come within known or customary practice in the art to which the invention pertains, and as may be applied to the essential features set forth, and fall within the scope of the invention or the limits of the appended claims.

What is claimed is:

1. A device in combination with a display case, comprising:

a) a rail disposed over a top exterior surface of said display case;

b) a support member;

c) a support surface on said support member;

d) an engagement surface being disposed on said support member and being positioned between said support surface and said rail, and substantially the entire surface of said engagement surface slidably engaging said rail for causing said support member to slide along said rail when a force is applied to said support member; and, e) said support surface being disposed substantially above said rail for supporting a piece of equipment substantially above said rail whereby the piece of equipment is easily accessible and viewable.

2. A device as recited in claim 1, wherein:

a) said rail has a generally v-shaped cross section.

3. A device as recited in claim 1, further including:

a) a damping member being disposed on said support member.

4. A device as recited in claim 1, wherein:

a) said rail has an engagement portion with a generally v-shaped cross section.

5. A device, as recited in claim 4, wherein:

a) said engagement portion of said rail has a generally inverted v-shaped cross section.

6. A device as recited in claim 1, wherein:

a) said engagement surface has a generally v-shaped cross section.

7. A device, as recited in claim 6, wherein:

a) said engagement surface has a generally inverted v-shaped cross section.

8. A device as recited in claim 1, wherein:

a) said rail has an engagement portion with a generally v-shaped cross section; and, b) said engagement surface has a generally v-shaped cross section, said engagement surface is adapted to engage said engagement portion of said rail for lessening vibration transfer from said rail to said support member.

9. A device as recited in claim 1, further comprising:

a) a damping member being disposed on said engagement surface of said support member.

10. A device, as recited in claim 9, wherein:

a) said damping member is a sliding block.

11. A device in combination with a display case, comprising:

a) a rail disposed over a top exterior surface of said display case;

b) a support member having a length, a support surface and an engagement surface; and, c) said engagement surface extending along said length of said support member, and substantially the entire surface of said engagement surface being in contact with said rail for causing said support member to move along said rail when a force is applied to said support member.

12. A device, as recited in claim 11, wherein:

a) said rail has a generally v-shaped cross section.

13. A device, as recited in claim 12, wherein:

a) said rail has a generally inverted v-shaped cross section.

14. A device, as recited in claim 11, wherein:

a) said engagement surface comprises a sliding block.

15. A device, as recited in claim 11, wherein:

a) said engagement surface has a length, and said length of said engagement surface is substantially equal to said length of said support member.

16. A device, as recited in claim 11, wherein:

a) said support surface is disposed substantially above said rail.

17. A device, as recited in claim 11, further comprising:

a) a damping member being disposed on said engagement surface of said support member.

18. A device, as recited in claim 11, wherein:

a) said engagement surface has a generally v-shaped cross section.

19. A device, as recited in claim 18, wherein:

a) said engagement surface has a generally inverted v-shaped cross section.

* * * * *